US005878597A

United States Patent [19]

Mueller et al.

[11] Patent Number: 5,878,597

[45] Date of Patent: Mar. 9, 1999

[54] CRYOGENIC RECTIFICATION SYSTEM WITH SERIAL LIQUID AIR FEED

[75] Inventors: Eric Owen Mueller, Buffalo; Dante Patrick Bonaquist; Cheryl Ann Engels, both of Grand Island; David Ross Parsnick, Lancaster; John Peter Ricotta, Buffalo, all of N.Y.

[73] Assignee: Praxair Technology, Inc., Danbury, Conn.

[21] Appl. No.: 59,263

[22] Filed: Apr. 14, 1998

[51] Int. Cl.[6] ..... F25J 3/04

[52] U.S. Cl. ..... 62/646; 62/654

[58] Field of Search ..... 62/643, 654, 646

[56] References Cited

U.S. PATENT DOCUMENTS 4,817,394 4/1989 Erickson .
5,036,672 8/1991 Rottmann .
5,365,741 11/1994 Roberts et al. .
5,398,514 3/1995 Roberts et al. .
5,402,646 4/1995 Rathbone ..... 62/654
5,440,884 8/1995 Bonaguist et al. .
5,511,381 4/1996 Higginbotham ..... 62/646
5,533,339 7/1996 Clare et al. ..... 62/654
5,655,388 8/1997 Bonaquist et al. ..... 62/651
5,692,396 12/1997 Rathbone ..... 62/646
5,692,397 12/1997 Higginbotham ..... 62/646

*Primary Examiner*—Christopher B. Kilner
*Attorney, Agent, or Firm*—Stanley Ktorides

[57] ABSTRACT

A cryogenic rectification system for the separation of feed air wherein at least some of the feed air is liquefied upstream of the separation columns, all of the liquefied feed air is introduced into a higher pressure column, and then a portion of this liquefied feed air is withdrawn from the higher pressure column and in serial fashion introduced into a lower pressure column.

9 Claims, 1 Drawing Sheet

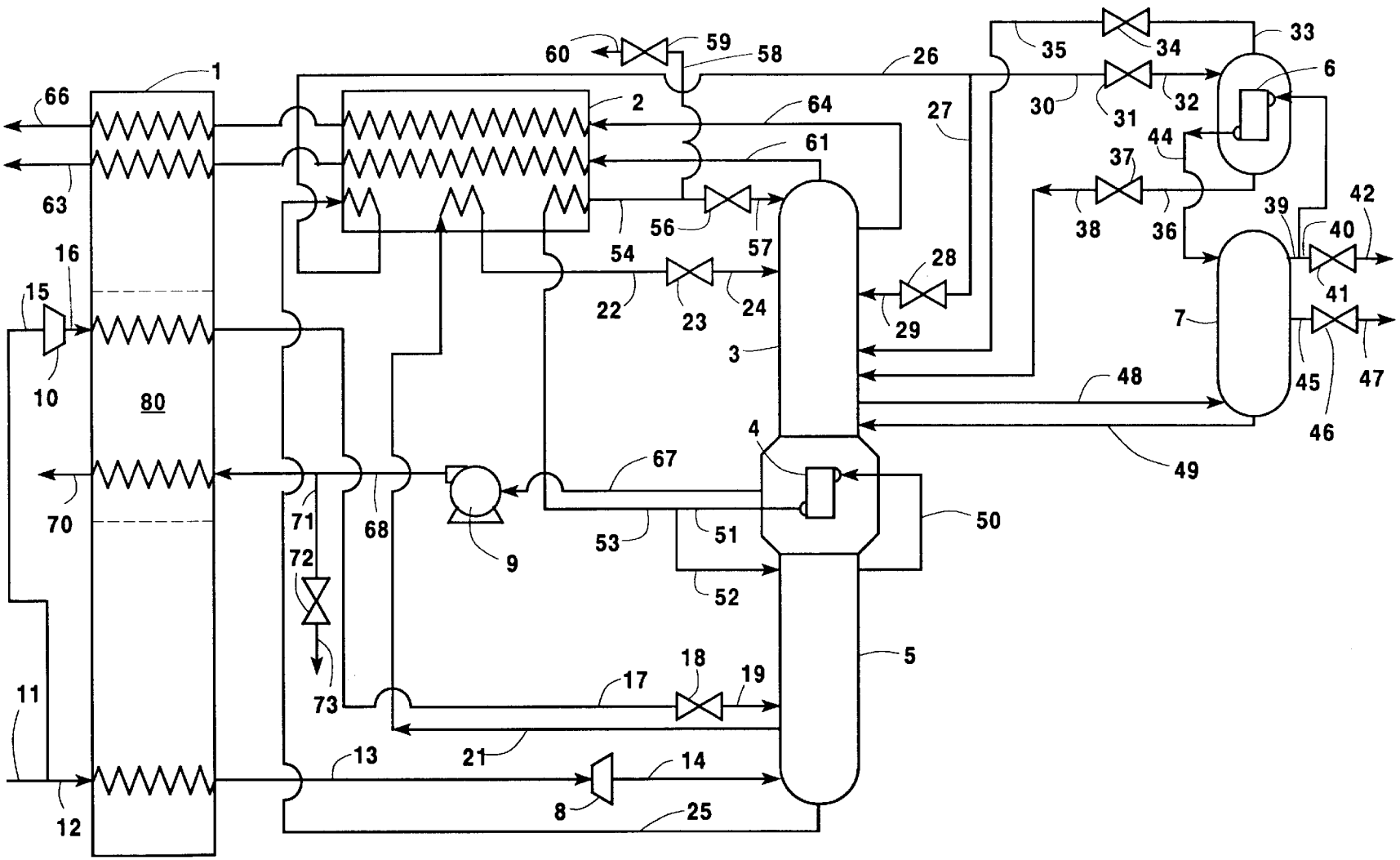
1
2
3
4
5
6
7
8
9
10
11
12
13
14
15
16
17
18
19
21
22
23
24
25
26
27
28
29
30
31
32
33
34
35
36
37
38
39
40
41
42
44
45
46
47
48
49
50
51
52
53
54
56
57
58
59
60
61
63
64
66
67
68
70
71
72
73
80

CRYOGENIC RECTIFICATION SYSTEM WITH SERIAL LIQUID AIR FEED

TECHNICAL FIELD

This invention relates generally to cryogenic rectification of feed air and is particularly useful in the cryogenic rectification of feed air to produce elevated pressure gaseous product.

BACKGROUND ART

Oxygen and nitrogen are produced commercially in large quantities by the cryogenic rectification of feed air, such as in a double column system wherein the product is taken from the lower pressure column. At times it may be desirable to produce the product at a pressure which exceeds its pressure when taken from the lower pressure column. In such instances, gaseous oxygen may be compressed to the desired pressure. However, it is generally preferable for capital cost purposes to remove the product as liquid from the lower pressure column, pump it to a higher pressure, and then vaporize the pressurized liquid to produce the desired elevated pressure product gas.

In such a system, generally termed a product boiling system, the liquid is vaporized in a product boiler by indirect heat exchange with a condensing fluid, typically pressurized feed air. The resulting liquid feed air is then passed into the cryogenic air separation plant for separation. Two liquid feed air arrangements are known. In one arrangement, all of the liquid feed air is passed into the higher pressure column wherein it undergoes cryogenic rectification. In another arrangement, the liquid feed air is divided into a first portion, which is passed into the higher pressure column, and into a second portion which is passed into the lower pressure column. The latter arrangement is preferred because it enables the cryogenic rectification plant to operate more efficiently due to judicious distribution of the incoming liquid feed air among the columns.

The cryogenic rectification of feed air, especially for the production of elevated pressure gaseous product, is an energy intensive operation and any improvement in energy efficiency is desirable.

Accordingly, it is an object of this invention to provide a system for the cryogenic rectification of feed air wherein at least some of the feed air is liquefied prior to entering the column or columns of the cryogenic air separation plant, which has improved efficiency over heretofore available such systems.

SUMMARY OF THE INVENTION

The above and other objects, which will become apparent to one skilled in the art upon a reading of this disclosure, are attained by the present invention, one aspect of which is:

A method for carrying out cryogenic rectification of feed air comprising:

(A) condensing feed air to produce liquid feed air and passing all of the liquid feed air into a higher pressure column at a liquid air feed level which is above the bottom of the higher pressure column;

(B) passing a first liquid stream taken from the higher pressure column at a level below the liquid air feed level into a lower pressure column;

(C) passing a second liquid stream taken from the higher pressure column at a level below the withdrawal level of the first liquid stream into the lower pressure column;

(D) producing nitrogen-rich fluid and oxygen-rich fluid by cryogenic rectification within the lower pressure column; and (E) recovering at least one of the nitrogen-rich fluid and oxygen-rich fluid as product.

Another aspect of the invention is:

Apparatus for carrying out cryogenic rectification of feed air comprising:

(A) a product boiler and means for passing feed air to the product boiler;

(B) a higher pressure column and means for passing feed air from the product boiler into the higher pressure column at a liquid air feed level which is above the bottom of the higher pressure column;

(C) a lower pressure column and means for passing a first fluid from below the liquid air feed level of the higher pressure column into the lower pressure column;

(D) means for passing a second fluid from below the withdrawal level of the first fluid from the higher pressure column into the lower pressure column; and (E) means for recovering product from the lower pressure column.

As used herein the term "feed air" means a mixture comprising primarily oxygen, nitrogen and argon, such as ambient air.

As used herein, the term "column" means a distillation or fractionation column or zone, i.e. a contacting column or zone, wherein liquid and vapor phases are countercurrently contacted to effect separation of fluid mixture, as for example, by contacting of the vapor and liquid phases on a series of vertically spaced trays or plates mounted within the column and/or on packing elements such as structured or random packing. For further discussion of distillation columns see the Chemical Engineer's Handbook, fifth edition, edited by R. H. Perry and C. H. Chilton, McGraw-Hill Book Company, New York, Section 13, The Continuous Distillation Process. The term, double column, is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "argon column" means a column which processes a feed comprising argon and produces a product having an argon concentration which exceeds that of the feed.

As used herein, the term "bottom" when referring to a column means that portion of the column below the mass transfer internals within that column.

As used herein, the term "product boiler" means a heat exhanger wherein feed air is condensed by indirect heat exchange with vaporizing liquid. The product boiler may be a separate or stand alone heat exchanger or may be incorporated into a larger heat exchanger.

As used herein, the term "superheater" means a heat exchanger wherein nitrogen-containing fluid from the lower pressure column is heated above its saturation temperature while cooling one or more streams. The superheater may be a separate heat exchanger or may be incorporated into a larger heat exchanger.

BRIEF DESCRIPTION OF THE DRAWING

The sole FIGURE is a schematic representation of one preferred embodiment of the cryogenic rectification system of this invention.

DETAILED DESCRIPTION

The invention incorporates the counterintuitive discovery that if all of the liquefied feed air produced in a product boiler is first introduced into a higher pressure column and subsequently a portion is withdrawn from the higher pressure column and passed into a lower pressure column, the cryogenic rectification can be carried out with greater energy and separation efficiency than is achievable with heretofore available systems employing a product boiler.

The invention will be discussed in detail with reference to the Drawing. Referring now to the FIGURE, gaseous feed air 11 which has been compressed to a pressure generally within the range of from 80 to 700 pounds per square inch absolute (psia) and cleaned of high boiling impurities such as carbon dioxide, water vapor and hydrocarbons, is divided into feed air stream 15, which comprises from about 20 to 35 percent of the total feed air represented by stream 11, and into feed air stream 12 which comprises from about 65 to 80 percent of stream 11. Feed air stream 12 is cooled by passage through primary heat exchanger 1 by indirect heat exchange with return streams and resulting cooled feed air stream 13 is turboexpanded through turboexpander 8 and passed as stream 14 into first or higher pressure column 5, preferably at the bottom of higher pressure column 5.

Feed air stream 15 is boosted in pressure by passage through booster compressor 10 to a pressure generally within the range of from 150 to 800 psia, and resulting pressurized stream 16 is passed through section 80 of primary heat exchanger 1 which is the product boiler wherein it is cooled and condensed by indirect heat exchange with pressurized oxygen-rich liquid, as will be more fully described below, to produce liquid feed air. All of the liquid feed air produced in product boiler 80 is passed from product boiler 80 in stream 17, through valve 18 wherein it is throttled and then in stream 19 into higher pressure column 5 at a level, termed the liquid air feed level, which is above the bottom of the column, preferably from 4 to 7 equilibrium stages above the bottom of higher pressure column 5.

The liquid feed air fed into higher pressure column 5 has an oxygen concentration of about 21 mole percent. In the practice of this invention a first liquid stream 21 is withdrawn from higher pressure column 5 at a level below the liquid air feed level. As used herein, the term "level" is synonymous with equilibrium stage. The oxygen concentration of first liquid stream 21 will be from about 21 mole percent to not more than 35 mole percent. Preferably, first liquid stream 21 has a composition substantially the same as that of liquid feed air 19. The level from which the first liquid stream is withdrawn from the higher pressure column is termed the liquid air withdrawal level. The flowrate of liquid stream 21 will be less than that of liquid feed air stream 19, and generally will be from 40 to 80 percent of the flowrate of stream 19. It is thus seen that streams 19 and 21 may be seen as serial liquid feed air streams. First liquid stream 21 is subcooled by passage through superheater 2 and resulting subcooled stream 22 is passed through valve 23 and then as stream 24 into lower pressure column 3.

Higher pressure column 5 is operating at a pressure generally within the range of from 75 to 90 psia. Within higher pressure column 5, the feed air is separated by cryogenic rectification into nitrogen-enriched vapor and oxygen-enriched liquid. Nitrogen-enriched vapor is withdrawn from the upper portion of higher pressure column 5 as stream 50 and passed into main condenser 4 wherein it is condensed by indirect heat exchange with lower pressure column 3 bottom liquid. Resulting nitrogen-enriched liquid 51 is divided into portion 52, which is returned to higher pressure column 5 as reflux, and into portion 53 which is subcooled by partial traverse of superheater 2. Resulting subcooled stream 54 is passed through valve 56 and as stream 57 into lower pressure column 3. If desired, a portion 58 of stream 54 may be passed through valve 59 and recovered as high pressure liquid nitrogen 60.

Oxygen-enriched liquid, having an oxygen concentration generally within the range of from about 35 to about 40 mole percent, is withdrawn from the lower portion of higher pressure column 5 as second liquid stream 25 at a level below the withdrawal level of first liquid stream 21, i.e. below the liquid air withdrawal level, and preferably from the bottom of column 5. Stream 25 is subcooled by partial traverse of superheater 2, and subcooled stream 26 is divided into first portion 27 and second portion 30. First portion 27 is passed through valve 28 and as stream 29 into lower pressure column 3. Second portion 30 is passed through valve 31 and as stream 32 into argon column top condenser 6 wherein it is at least partially, and preferably essentially completely, vaporized. Resulting oxygen-enriched vapor is passed in stream 33 from top condenser 6 through valve 34 and as stream 35 into lower pressure column 3 at a level from 5 to 10 equilibrium stages below the point where stream 29 is passed into lower pressure column 3. Remaining liquid is passed in stream 36 from top condenser 6, passed through valve 37 and as stream 38 in lower pressure column 3.

Second or lower pressure column 3 is the lower pressure column of a double column which also comprises higher pressure column 5, and is operating at a pressure less than that of higher pressure column 5 and generally within the range of from 15 to 25 psia. Within lower pressure column 3 the various feeds into the column are separated by cryogenic rectification into nitrogen-rich vapor and oxygen-rich liquid. Nitrogen-rich vapor is withdrawn from the upper portion of lower pressure column 3 as stream 61, warmed by passage through superheater 2 and primary heat exchanger 1, and withdrawn from the system in stream 63 which may be recovered as low pressure gaseous nitrogen having a nitrogen concentration of at least 99 mole percent. A waste stream 64 is withdrawn from lower pressure column 3 at a level below the withdrawal level of stream 61, warmed by passage through superheater 2 and primary heat exchanger 1 and removed from the system in stream 66.

Oxygen-rich liquid is withdrawn from the lower portion of lower pressure column 3 in stream 67 and is pressurized to produce high pressure oxygen-rich liquid having a pressure generally within the range of from 50 to 450 psia. In the embodiment of the invention illustrated in the FIGURE, the pressurization is attained by passing stream 67 through liquid pump 9 to produce high pressure oxygen-rich liquid stream 68. Stream 68 is passed into product boiler 80 wherein it is at least partially vaporized by indirect heat exchange with the aforesaid condensing feed air. If desired, some oxygen-rich liquid may be taken from stream 68 in stream 71, passed through valve 72 and recovered as liquid oxygen product 73. Vaporized oxygen-rich fluid is withdrawn from product boiler section 80 in stream 70 and recovered as high pressure oxygen gas product at a pressure generally within the range of from 50 to 450 psia and having an oxygen concentration generally within the range of from 99.5 to 99.9 mole percent.

A stream comprising primarily oxygen and argon is passed in stream 48 from lower pressure column 3 into argon column 7 wherein it is separated by cryogenic rectification into argon-richer vapor and oxygen-richer liquid. Oxygen-richer liquid is passed from argon column 7 into lower pressure column 3 in stream 49. Argon-richer vapor is passed in stream 39 into top condenser 6 wherein it is condensed by indirect heat exchange with the aforesaid vaporizing oxygen-enriched liquid. Resulting argon-richer liquid is passed out of top condenser 6 in stream 44 and is passed into argon column 7 as reflux. A portion 40 of stream 39 may be passed through valve 41 and vented as gaseous crude argon 42. Liquid argon may be withdrawn from column 7 in stream 45 passed through valve 46 and recovered as liquid argon 47.

It would be expected that if one desired to provide condensed feed air into both the higher pressure and lower pressure columns, one would divide the liquid feed air into two streams which would be passed respectively into the higher pressure column and lower pressure column, and, in fact, such a system is commercially practiced. Unexpectedly, it has been found that, instead of this conventional practice, if all the liquid feed air is first introduced into the higher pressure column and then a fraction of this liquid feed air passed from the higher pressure to the lower pressure column in a serial fashion, certain efficiencies are realized. While not wishing to be held to any theory, it is believed that the advantageous results attainable with the invention are due to the pressure reduction of the liquid feed air stream to the higher pressure column which reduces the pressure of the liquid stream to the superheater. This not only reduces the cost of the superheater, but also decreases the warming side pressure drop in the superheater therefore reducing power consumption. Moreover, since the liquid feed air, i.e. the first liquid stream, being fed into the lower pressure column is at a lower pressure, there is less flash off thereby enhancing separation efficiency. Still further, the higher pressure column acts as a phase separator for the liquefied feed air, further enhancing system efficiencies.

Although the invention has been described in detail with reference to a certain preferred embodiment, those skilled in the art will recognize that there are other embodiments of the invention within the spirit and the scope of the claims. For example, the liquid feed air may be passed through a two phase or liquid turbine prior to being passed into the higher pressure column. The first liquid stream, i.e. stream 21, may be passed into the lower pressure column without subcooling. The entire oxygen-enriched liquid stream from the higher pressure column may be passed into the argon column top condenser and the liquid therefrom passed into the lower pressure column as the second liquid stream. Alternatively, the invention need not be practiced with an argon column, and in such instance, the entire oxygen-enriched liquid stream from the higher pressure column would be passed into the lower pressure column as the second liquid stream. Furthermore, as mentioned previously, the product boiler may be separate from the primary heat exchanger.

What is claimed is:

1. A method for carrying out cryogenic rectification of feed air comprising:

(A) condensing feed air to produce liquid feed air and passing all of the liquid feed air into a higher pressure column at a liquid air feed level which is above the bottom of the higher pressure column;

(B) passing a first liquid stream taken from the higher pressure column at a level below the liquid air feed level into a lower pressure column;

(C) passing a second liquid stream taken from the higher pressure column at a level below the withdrawal level of the first liquid stream into the lower pressure column;

(D) producing nitrogen-rich fluid and oxygen-rich fluid by cryogenic rectification within the lower pressure column; and (E) recovering at least one of the nitrogen-rich fluid and oxygen-rich fluid as product.

2. The method of claim 1 wherein the first liquid stream has a composition substantially the same as that of the liquid feed air passed into the higher pressure column.

3. The method of claim 1 wherein the first liquid stream is subcooled prior to being passed into the lower pressure column.

4. The method of claim 1 wherein the oxygen-rich fluid is withdrawn from the lower pressure column as liquid, increased in pressure, and then vaporized by indirect heat exchange with said condensing feed air to produce said liquid feed air and to produce elevated pressure gaseous oxygen which is recovered as product.

5. The method of claim 1 wherein the flowrate of the first liquid stream taken from the higher pressure column is within the range of from 40 to 80 percent of the flowrate of the liquid air feed into the higher pressure column.

6. Apparatus for carrying out cryogenic rectification of feed air comprising:

(A) a product boiler and means for passing feed air to the product boiler;

(B) a higher pressure column and means for passing feed air from the product boiler into the higher pressure column at a liquid air feed level which is above the bottom of the higher pressure column;

(C) a lower pressure column and means for passing first fluid from below the liquid air feed level of the higher pressure column into the lower pressure column;

(D) means for passing a second fluid from below the withdrawal level of the first fluid from the higher pressure column into the lower pressure column; and (E) means for recovering product from the lower pressure column.

7. The apparatus of claim 6 wherein the liquid air feed level is from 4 to 7 equilibrium stages above the bottom of the higher pressure column.

8. The apparatus of claim 6 further comprising a superheater and wherein the means for passing the first fluid from the higher pressure column to the lower pressure column includes the superheater.

9. The apparatus of claim 6 wherein the means for recovering product from the lower pressure column comprises a liquid pump, means for passing fluid from the lower pressure column to the liquid pump, means for passing fluid from the liquid pump to the product boiler, and means for recovering fluid from the product boiler.

* * * * *